United States Patent [19]

Guillou et al.

[11] Patent Number: 4,850,903

[45] Date of Patent: Jul. 25, 1989

[54] SYSTEM FOR CONNECTING ELEMENTS OPERATING AT ULTRAHIGH FREQUENCY, INCORPORATING A JOINT

[75] Inventors: Bernard P. V. Guillou, Saint Aubin due Medoc; Pierre V. A. Lahitte, Salaunes, both of France

[73] Assignee: Aerospatiale Societe Nationale Industrielle, Paris, France

[21] Appl. No.: 225,778

[22] Filed: Jul. 29, 1988

[30] Foreign Application Priority Data

Aug. 3, 1987 [FR] France ..... 87 11011

[51] Int. Cl.[4] ..... H01R 4/30

[52] U.S. Cl. ..... 439/784; 439/805

[58] Field of Search ..... 439/801, 805, 784, 791, 439/792; 403/260, 296, 343

[56] References Cited

U.S. PATENT DOCUMENTS

| | | | |
|---|---|---|---|
| 3,144,803 | 8/1964 | Briles | 439/801 |
| 4,157,725 | 6/1979 | Stanaitis | 439/801 |
| 4,671,583 | 6/1987 | Olson et al. | 439/801 |
| 4,755,079 | 7/1988 | Nishino | 403/296 |

*Primary Examiner*—Gary F. Paumen

*Attorney, Agent, or Firm*—Fisher, Christen & Sabol

[57] ABSTRACT

This invention relates to a system for establishing at ultrahigh frequency the electrical continuity between two conductive elements, wherein:

the annular joint is made of a resilient metal and is in the form of a washer;

the junction face of one of said conductive elements comprises an annular projection directed towards the other conductive element and surrounding a recess;

the junction face of the other of said conductive elements comprises at least one bearing portion disposed opposite said annular projection, so that the peripheral part of said washer can be pressed between said annular projection and said bearing portion, due to the action of said tightening means; and blocking means are provided to maintain the central part of said washer inside said recess, so that, when said conductive elements are pressed against each other, said washer deforms elastically in non-irreversible manner, to take the shape of a flare widening in the direction of said other element.

7 Claims, 1 Drawing Sheet

SYSTEM FOR CONNECTING ELEMENTS OPERATING AT ULTRAHIGH FREQUENCY, INCORPORATING A JOINT

The present invention relates to a system for establishing, at ultrahigh frequency, the electrical continuity between two conductive elements.

To that end, systems are already known which comprise an annular, electrically conductive joint, which is disposed between the cooperating junction faces provided respectively on said conductive elements and which is pressed between said junction faces due to the action of means for tightening said conductive elements against each other.

In these known systems, said joints are made either of an electrically conductive silicon, or a knit of conductive wires. In both cases, the electrical connection between the two conductive elements results from the shaping of said joints under the action of the pressure exerted thereon by said conductive elements subjected to the action of said tightening means. Now, such a shaping of the joints is assimilated to creeping, which results in that:

the electrical continuity between the two elements cannot be obtained immediately after tightening thereof;

the quality of the electrical continuity (attenuation coefficient and reflection coefficient) depends on the tightening of said elements; and the repeatability of a particular state of electrical continuity cannot be ensured.

These known systems can therefore not be used if a virtually immediate electrical continuity and a repeatability of connection are sought at the same time. These known systems are therefore limited to permanent links.

It is an object of the present invention to overcome these drawbacks. It relates to a system allowing, at ultrahigh frequency, the virtually instantaneous electrical continuity, constant in time and repetitive, between two elements.

To that end, according to the invention, the system for establishing, at ultrahigh frequency, the electrical continuity between two conductive elements, said system comprising an annular, electrically conductive joint, which is disposed between cooperating junction faces provided respectively on said conductive elements and which is pressed between said junction faces due to the action of means for tightening said conductive elements against each other, is noteworthy in that:

said annular joint is made of a resilient metal and is in the form of a washer;

the junction face of one of said conductive elements comprises an annular projection directed towards the other conductive element and surrounding a recess;

the junction face of the other of said conductive elements comprises at least one bearing portion disposed opposite said annular projection, so that the peripheral part of said washer can be pressed between said annular projection and said bearing portion, due to the action of said tightening means; and blocking means are provided to maintain the central part of said washer inside said recess, so that, when said conductive elements are pressed against each other, said washer deforms elastically in non-irreversible manner, to take the shape of a flare widening in the direction of said other element.

In order to facilitate both the elastic deformation of said washer during tightening of said conductive elements and the elastic return of said washer to its shape of rest when said elements are loosened, it is advantageous if said washer prevents a truncated shape.

Said washer may be made of beryllium copper, possibly heat-treated.

The washer may be borne by said other of said conductive elements and be brought into contact with the element provided with the circular projection only at the moment when said elements are tightened. In that case, said blocking means may be borne by this other element. However, in an advantageous embodiment, said blocking means establish a mechanical connection between the central part of the washer and the central part of said recess. Moreover, it is advantageous if said blocking means ensure centering of said washer with respect to said annular projection. For example, these blocking means comprise a spindle secured to the element provided with the projection, said washer being transversed by said spindle. Said spindle preferably bears a head disposed in the convexity of the washer and serving as an outward stop thereof.

In order to be able to adjust the pressure of said washer against said element comprising the annular projection, before said elements are tightened against each other, said spindle is preferably a screw engaged in a tapped hole made in said element.

The invention will be more readily understood on reading the following description with reference to the accompanying drawings, in which.

Figure 1:
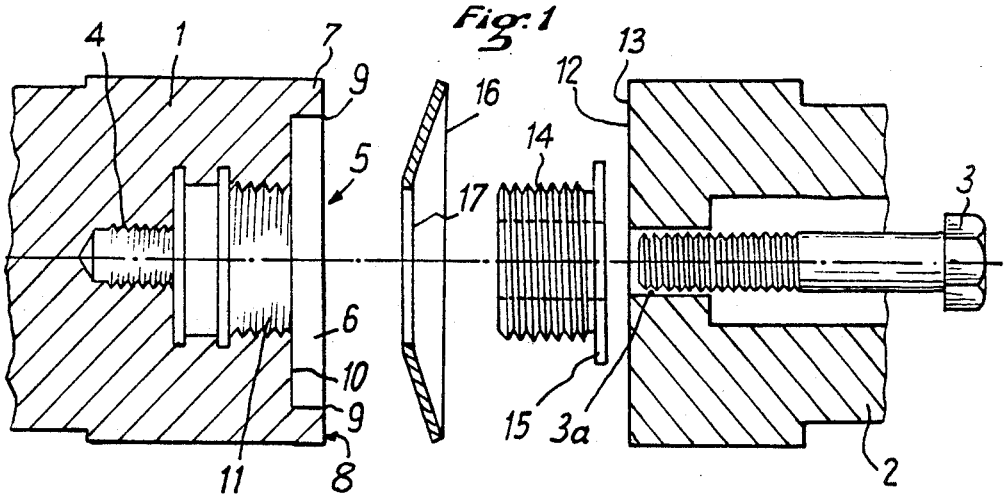
FIG. 1 is an exploded view, in longitudinal section, of an embodiment of the system according to the present invention.

Referring now to the drawings, the system shown therein is intended to establish electrical continuity, at ultrahigh frequency, between two conductive elements 1 and 2, capable of being pressed against each other via at least one screw 3 which traverses the element 2 through a hole 3*a* and which is adapted to cooperate with a tapped hole 4 made in the element 1.

Element 1 comprises a junction face 5, directed towards element 2 and provided with a recess 6, which is surrounded by an annular projection 7. The face 8 of the annular projection 7, directed towards element 2, is advantageously flat and is limited, on the recess 6 side, by a circular edge 9. In the bottom 10 of the recess 6 is made a tapped hole 1, for example coaxial to tapped hole 4.

Element 2 comprises a junction face 12 which comprises at least one annular bearing portion 13 adapted to be applied against face 8 of the annular projection 7 of element 1.

A screw 14, provided with a head 15, is adapted to be screwed in the tapped hole 11 of element 1.

The system further comprises a truncated washer 16, pierced with a central hole 17, and made of an elastically deformable metallic material such as beryllium copper, possibly having undergone a heat treatment in order to increase its elastic deformability. The diameter of the washer 16 is larger than that of the circular edge 9.

Figure 2:
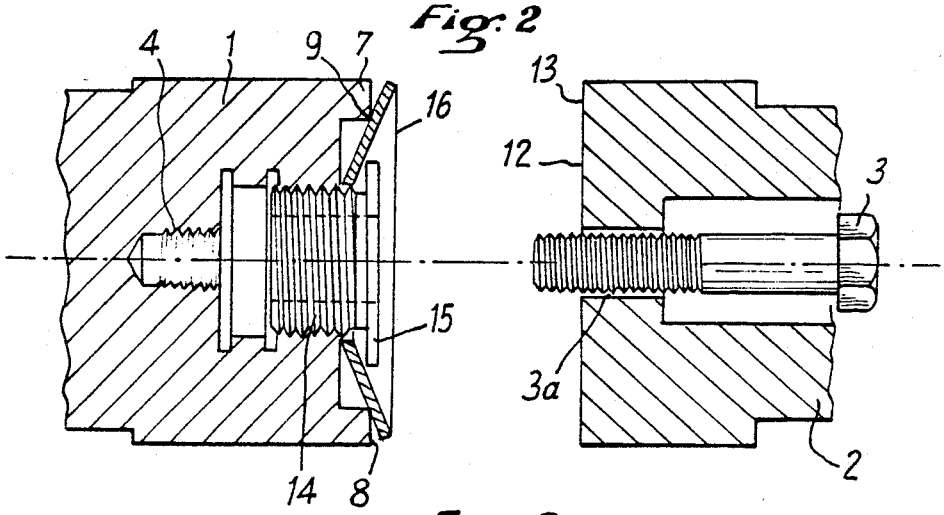
FIG. 2 shows the system of FIG. 1 in the course of assembly.

As illustrated in FIG. 2, in order to assemble the system according to the present invention, the screw 14 is first introduced in the central hole 17 of the washer 16, so that the head 15 of said screw lies in the concavity of said washer. Screw 14 is then screwed in the tapped hole 11 of element 1, the convexity of the washer 16 then being directed towards the recess 6.

Screwing of screw 14 in the tapped hole is preferably continued until the convex surface of the washer 16 comes into abutment against the inner circular edge 9 of the annular projection 7 (cf. FIG. 2). It is also preferable if, in this position, the head 15 of the screw 14 is in abutment against the concave surface of the washer 16 and if the periphery of the central hole 17 is pressed against the bottom 10 of the recess. In this position, the screw 14 may, or may not, exert a pressure stress on the washer 16. Moreover, this position may correspond to the maximum screwing of screw 14 in the tapped hole 11.

Although the position described hereinabove is the preferred one, it is not compulsory and, as will be seen hereinafter, the washer 16 may, at this instant of assembly, not be rendered rigidly fast with element 1 via screw 14. On the contrary, this screw 14 may ensure only a loose connection between washer 16 and element 1, said washer then being able to slide in limited manner on screw 14 between two stops constituted respectively by the inner circular edge 9 of the projection 7 and by the head 15 of the screw 14.

Whatever the degree of rigidity of the connection between screw 14 and element 1, it is seen that screw 14, in cooperation with the edge of the central hole 17 of washer 16, ensures guiding and centering thereof, with respect to the annular projection 7.

After the washer 16 has been positioned on element 1, element 2 is brought towards element 1 and screw 3 is screwed into tapped hole 4. During such screwing, the annular bearing portion 13 of the junction face 12 presses the peripheral part of washer 16 in the direction of face 8 of the projection 7. Screw 3 continues to be screwed until this peripheral part of the washer 16 is strongly pressed between face 8 of projection 7 and said annular bearing portion 13.

Figure 3:
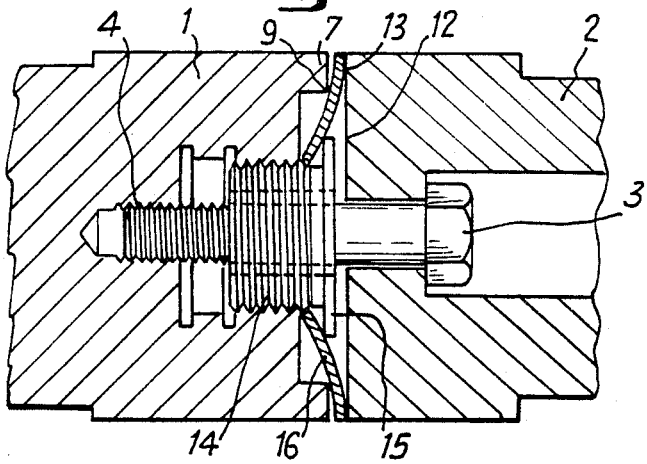
FIG. 3 shows the system of FIGS. 1 and 2 at the end of assembly, but before the two conductive elements are completely tightened against each other.

Since the central part of washer 16 is captive by means of screw 14 (whatever the tightening of screw 14 in tapped hole 11), said washer takes approximately the form of the flared mouth of a wind instrument (cf. FIG. 3).

When screw 3 is unscrewed and elements 1 and 2 are moved apart, the pressure undergone by washer 16 decreases until it resumes its initial shape (FIGS. 1 and 2).

What is claimed is:

1. A system for establishing, at ultrahigh frequency, the electrical continuity between two conductive elements, said system comprising an annular, electrically conductive joint in the form of an elastically deformable washer, which is disposed between cooperating junction faces provided respectively on said conductive elements and which is pressed between said junction faces due to the action of means for tightening said conductive elements against each other, wherein, the junction face of one of said conductive elements comprises an annular projection directed towards the other conductive element and surrounding a recess on said one conductive element;

the junction face of the other of said conductive elements comprises a least one bearing portion disposed opposite said annular projection, so that the peripheral part of said washer can be pressed between said annular projection and said bearing portion, due to the action of said tightening means; and blocking means separate from said tightening means is provided to maintain the central part of said washer inside said recess, so that, when said conductive elements are pressed against each other, said washer deforms elastically in non-irreversible manner, to take the shape of a flare widening in the direction of said other element.

2. The system of claim 1, wherein said washer means is truncated.

3. The system of claim 1, wherein said blocking means establishes a mechanical connection between the central part of the washer and the central part of said recess.

4. The system of claim 3, wherein said blocking means ensures centering of said washer with respect to said annular projection.

5. The system of claim 4, wherein said blocking means comprises a spindle which is secured to the element provided with the annular projection.

6. The system of claim 5, wherein the spindle bears a head disposed on the convex side of the washer and serving as an outward stop thereof.

7. The system of claim 6, wherein said spindle is a screw engaged in a tapped hole made in said recess.

* * * * *